US011583099B2

(12) United States Patent
Li

(10) Patent No.: US 11,583,099 B2
(45) Date of Patent: Feb. 21, 2023

(54) DUAL-CHAMBER AIR BED

(71) Applicant: WangLi Plastic & Electronics (Huizhou) Co., Ltd., Guangdong (CN)

(72) Inventor: Yonghe Li, Guangdong (CN)

(73) Assignee: WANGLI PLASTIC & ELECTRONICS (HUIZHOU) CO., LTD., Guangdong (CN)

( * ) Notice: Subject to any disclaimer, the term of this patent is extended or adjusted under 35 U.S.C. 154(b) by 95 days.

(21) Appl. No.: 17/139,705

(22) Filed: Dec. 31, 2020

(65) Prior Publication Data

US 2022/0202198 A1 Jun. 30, 2022

(51) Int. Cl.
*A47C 27/08* (2006.01)
*A47C 27/10* (2006.01)

(52) U.S. Cl.
CPC ..... *A47C 27/082* (2013.01); *A47C 27/087* (2013.01); *A47C 27/10* (2013.01)

(58) Field of Classification Search
CPC ..... A47C 27/082; A47C 27/087; A47C 27/10
See application file for complete search history.

(56) References Cited

U.S. PATENT DOCUMENTS 6,240,584 B1 * 6/2001 Perez ..... A47C 27/082 5/713
7,089,618 B1 * 8/2006 Metzger ..... A47C 27/087 5/709
9,848,706 B2 * 12/2017 Wang ..... A47C 4/54
2003/0101516 A1 * 6/2003 Hsu ..... A47C 27/087 5/710
2007/0266494 A1 * 11/2007 DeLuca ..... A61G 7/1028 5/81.1 R
2008/0000030 A1 * 1/2008 Wang ..... A47C 27/087 5/713
2021/0259434 A1 * 8/2021 Wang ..... A47C 27/10

FOREIGN PATENT DOCUMENTS

CN 206166388 U * 5/2017
CN 110680113 A * 1/2020
CN 110680114 A * 1/2020 ..... A47C 27/081
CN 212165393 U * 12/2020
WO WO-2015101632 A1 * 7/2015 ..... D04B 21/18
WO WO-2020238197 A1 * 12/2020

* cited by examiner

*Primary Examiner* — David R Hare
*Assistant Examiner* — Alexis Felix Lopez
(74) *Attorney, Agent, or Firm* — Muncy, Geissler, Olds & Lowe, P.C.

(57) ABSTRACT

A dual-chamber air bed includes an air pump, a bed body air chamber and peripheral air chambers. The air bed is enclosed by a top surface, a bottom surface and a side wall. An upper supplementary-material encircling piece is provided between the top surface and the side wall; a lower supplementary-material encircling piece is provided between the bottom surface and the side wall. The peripheral air chambers are enclosed by the top surface, the side wall and the upper supplementary-material encircling piece, and by the bottom surface, the side wall and the lower supplementary-material encircling piece. The bed body air chamber is enclosed by the top surface, the bottom surface, the side wall, the upper supplementary-material encircling piece, and the lower supplementary-material encircling piece.

10 Claims, 4 Drawing Sheets

DUAL-CHAMBER AIR BED

TECHNICAL FIELD

The utility model relates to the technical field of inflatable products, in particular to a dual-chamber air bed.

BACKGROUND ART

At present, existing air beds in the market are generally not provided with a single independent peripheral air chamber, and are only formed with an inflation chamber. Therefore, a bed body of this kind is rather unstable, and people are apt to fall once they sit on the bed. In addition, since air pressures and forces of the middle and the edge of the air bed easily tend to be uneven due to the fact that the air bed tends to expand to the middle, people are apt to slide down.

In addition, the air beds in the prior art are generally provided with drawstrings in the inflation chamber so as to enable the air bed to form a certain shape and have a flat surface. The drawstrings used by traditional inflatable mattress are all surface sheets and bottom sheets vertically connected to the inflatable mattress, and the drawstrings may exert pulling forces in a vertical direction on the surface sheets and the bottom sheets upon inflation of the inflatable mattress. However, the inflatable mattress with such a structure has the following deficiencies. Firstly, a joint seam at which a drawstring connects a surface sheet or a bottom sheet is relatively concentrated with force, so that a joint where the drawstring connects the surface sheet or the bottom sheet easily breaks, or the surface sheet or the bottom sheet is torn apart. Secondly, the bed body is easy to be partially collapsed or convex upwards to be inclined without enough stability, thereby affecting the using effect and service life.

UTILITY MODEL CONTENT

The utility model aims to overcome at least one defect in the prior art, provides a dual-chamber air bed which is simultaneously arranged with a bed body air chamber and peripheral air chambers that are inflated respectively, so that the bed has more stability as an beneficial effect.

The technical solution adopted by the utility model is as follows. A dual-chamber air bed includes an air pump, a bed body air chamber and peripheral air chambers. The air bed is enclosed by a top surface, a bottom surface and a side wall. An upper supplementary-material encircling piece is provided between the top surface and the side wall; a lower supplementary-material encircling piece is provided between the bottom surface and the side wall; the peripheral air chambers are enclosed by the top surface, the side wall and the upper supplementary-material encircling piece, or by the bottom surface, the side wall and the lower supplementary-material encircling piece; and the bed body air chamber is enclosed by the top surface, the bottom surface, the side wall, the upper supplementary-material encircling piece, and the lower supplementary-material encircling piece. The air pump is provided with two inflation-deflation devices, which are independently operated and connect the bed body air chamber and the peripheral air chambers respectively to perform independent inflation and deflation on the bed body air chamber and the peripheral air chambers.

According to the technical solution, the arrangement of the peripheral air chambers enables the periphery of the air bed to be more stable and firm, and can effectively prevent people from sliding off once people lie on the bed. The arrangement of two independently operated inflation-deflation devices to perform independent inflation and deflation on the peripheral air chambers and the bed body air chamber can better control an amount of gas required by the peripheral air chambers and the bed body air chamber and meet the demands of people.

In the prior art, when the edge of the air bed is subjected to force, a bed body is easy to be partially collapsed or tilt without enough stability due to limited support strength of a side wall and drawstrings. According to the technical solution, a mattress body is enclosed by the top surface, the side wall and the bottom surface so as to form a cuboid shape, and the peripheral air chambers form bed edges of the air bed, which effectively improves the supporting strength of the bed edges. An upper bed edge is higher than the other positions of the top surface so as to achieve the function of intercepting and limiting, so that a quilt can be effectively prevented from slipping off, and a user can be prevented from sliding off from a mattress during sleep. The arrangement of a lower bed edge increases friction between the mattress and the bottom surface, which achieves greater grip force of the mattress body that grasps the ground with more stability and realizes slip-resistance and increasing the comfort of use.

Further, the inflation-deflation device connected with the peripheral air chambers is a peripheral inflation-deflation device, and the peripheral air chambers are divided into an upper peripheral air chamber and a lower peripheral air chamber. An air outlet of the peripheral inflation-deflation device is communicated with the upper peripheral air chamber and the lower peripheral air chamber respectively.

Further, the upper peripheral air chamber is higher than the other positions of the top surface so as to achieve the function of intercepting and limiting, so that the quilt can be effectively prevented from slipping off, and the user can be prevented from sliding off from the mattress during sleep. The arrangement of the lower peripheral air chambers increases the friction between the air bed and the bottom surface so as to achieve greater grip force of the air bed that grasps the ground with more stability, thereby realizing slip-resistance and increasing the comfort of use.

Further, the air outlet of the peripheral inflation-deflation device is provided with a double-pass device having two outlets corresponding to two tubes that are respectively connected with the upper peripheral air chamber and the lower peripheral air chamber.

The technical solution ingeniously arranges two tubes at the air outlet of the peripheral inflation-deflation device, so that inflation and deflation can be performed on the upper peripheral air chamber and the lower peripheral air chamber without an additional peripheral inflation-deflation device, and the cost is saved as a beneficial effect.

Each inflation amount of the upper peripheral air chamber and the lower peripheral air chamber can be controlled by a space size of the air outlet occupied by the tube, in which the tube occupying a larger space of the air outlet obtains more air intake during the same time and has a larger hardness value of the corresponding air chamber.

Further, an inflation-deflation device connected with the bed body air chamber is a bed body inflation-deflation device, the air pump is provided on the side wall of the bed body air chamber, and an air outlet of the bed body inflation-deflation device is provided in the bed body air chamber.

According to the technical solution, the peripheral inflation-deflation device is communicated with the peripheral air chambers through tubes, and the bed body inflation-deflation device is in direct communication with the bed body air chamber, so that different air chambers can be respectively inflated and deflated by the same air pump, which has beneficial effects of being simple, convenient, and cost saving.

Further, drawstrings are provided in the bed body air chamber and are at least partially provided in the bed body air chamber in an inclined manner.

According to the technical solution, the top surface of the mattress body corresponds to the surface that the user lies on, the bottom surface of the mattress body corresponds to the surface in contact with the ground, and the drawstrings act to restrain the mattress body from becoming a bed body in a flat shape. However, due to a consistent force direction, the vertically arranged drawstrings still can cause projections of the top surface and the periphery of the mattress body, that is, bread-like projections are formed, thus leading to poor aesthetics of the mattress. Vertical lines at the top of the drawstrings and that at the bottom of the drawstrings are not on the same straight line, and force bearing points of the top surface and the bottom surface are spaced apart from each other, so that the top surface and the bottom surface of the mattress body can have better constraints and can function to limit projections of the top surface and the periphery of the mattress body. Meanwhile, the top surface and the bottom surface of the mattress body can receive more even forces and have better stability.

Further, the drawstrings are connected with the top surface and the bottom surface of the bed body air chamber respectively, and form included angles with the bottom surface, in which the included angles gradually increase from both sides of the bed body air chamber to the middle of the bed body air chamber and tend to be right angles.

Further, an angle range of each included angle a formed by a drawstring and the bottom surface is 60 to 90 degrees.

Further, elasticity of the top surface of the air bed is greater than that of the bottom surface.

Greater elasticity leads to a lower PVC hardness value, a larger expansion coefficient, a greater elasticity degree, and an easier tendency to be deformed. A parameter PHR means the parts of added rubber or resin per 100 parts (by mass) in PVC material, and a PVC hardness degree of the PVC is indirectly indicated by the parts of indirect adding of the rubber or the resin. According to the air bed in the present technical solution, the PVC hardness degree of the top surface is 35 to 45 PHR, and the PVC hardness degree of the bottom surface is 55 to 75 PHR. In this way, the air bed is kept flat with pleasing appearance, the surface of the air bed is prevented from forming the bread-like projections, which can better match and adapt to the hardness degree and the elasticity of the bed body.

Further, the PVC hardness degree of a bonding layer of the top surface is 40 PHR, and the PVC hardness degree of a bonding layer of the bottom surface is 60 to 70 PHR.

According to the air bed in the present technical solution, the top surface of the bed body is formed by bonding a flock layer and a PVC/TPU layer, both the bottom surface and the side wall of the mattress body are formed by bonding a cloth layer and a PVC/TPU layer, in which the flock layer of the top surface is provided outside the PVC/TPU layer, the cloth layers on the bottom surface and the side wall are provided outside the PVC/TPU layer, and the PVC/TPU layers between the top surface and the side wall and between the bottom surface and the side wall are welded to each other to form a mattress structure.

By arranging the flock layer on the top surface of the air bed, noise generated by friction between PVC material and human body can be reduced. In addition, the flock on the top surface of the air bed enables the air bed to be more delicate with air ventilation, which provides a more comfortable feeling when human skin touches the bed and improves the comfort of use. Moreover, the cloth layer can reduce the noise generated when the air bed is touched, avoid rupture, and improve service life of the air bed. In addition, an air bed in the prior art tends to expand into an arc shape after inflation, which results in that the mattress body has bread-like projections, the air bed is not flat enough and does not have pleasing appearance, and the service life is affected. The arrangement of the cloth layer limits the expansion of the PVC/TPU layer, so that the stretch of the whole air bed is flatter with more pleasing appearance, a technical effect that the whole air bed is not easily deformed is achieved, the hardness degree of the air bed is improved, a higher comfort degree of the air bed is realized, and the service life is prolonged.

Further, the cloth layer is made of nylon, or polyester, or polyester-cotton blended fabrics, or cotton cloth, or mesh cloth.

Further, the drawstrings are in a sheet-like or columnar or ring structure. The sheet-like drawstrings are provided along inner circumference of the mattress body, and have a curved or linear design at a joint of the top surface/bottom surface of the mattress body. The drawstrings in the columnar or ring structure are uniformly provided in the mattress body and are arranged in a matrix form. The bed drawstrings in the present technical solution are not limited to the structural designs described above, and can be in other design styles.

Further, the upper supplementary-material encircling piece and the lower supplementary-material encircling piece are made of PVC/TPU material, and are successively welded or bonded end to end to enclose a rectangular shape by PVC/TPU sheet materials.

Compared with the prior art, the beneficial effects of the present utility model are as follows.

(1) The arrangement of the peripheral air chambers enables the periphery of the air bed to be more stable and firm, and can effectively prevent people from sliding off once people lie on the bed. The arrangement of two independently operated inflation-deflation devices is used to perform independent inflation and deflation on the peripheral air chambers and the bed body air chamber, which can better control an amount of gas required by the peripheral air chambers and the bed body air chamber and meet the demands of people.

(2) According to the technical solution, the drawstrings are obliquely arranged, so that the force bearing points of the top surface and the bottom surface with the same drawstring are spaced apart from each other. Therefore, the top surface and the bottom surface can receive more even forces, and bread-like outward projection degrees of a surface sheet and periphery of the mattress are greatly reduced to achieve a more pleasing appearance of the mattress body. Meanwhile, the drawstrings are arranged to be gradually inclined outwards from the top surface to the bottom surface and have increasing oblique angles from center to the outside, so that the bottom surface of the mattress grasps the ground with more stability, and the stability and flatness of the mattress body is guaranteed.

DETAILED DESCRIPTION

Figure 1:
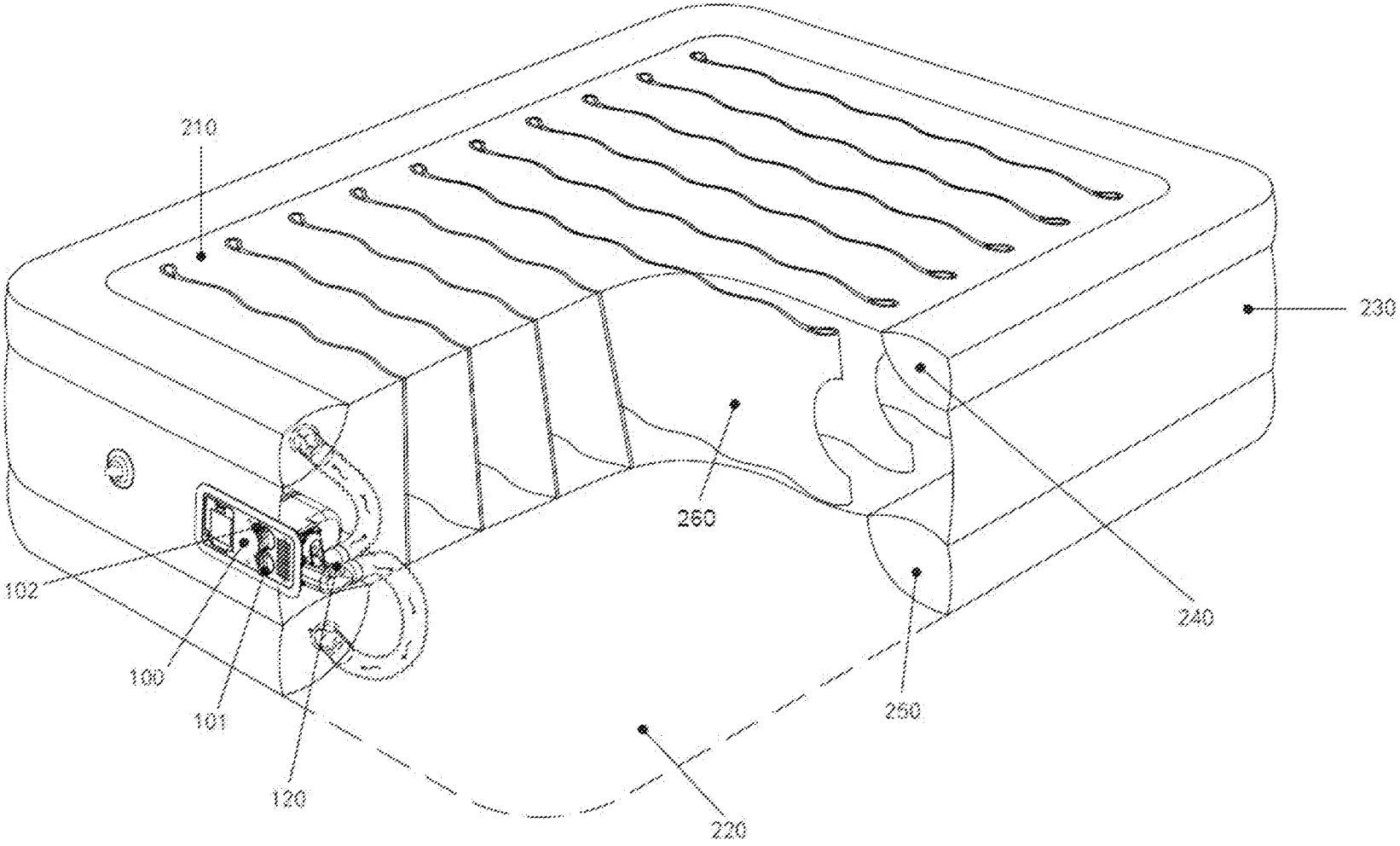
FIG. 1 is a schematic perspective view of an air bed in the present utility model.

The drawings of the present utility model are for illustration purpose only and are not intended to limit the present utility model. Some components in the drawings may be omitted, enlarged, or reduced for better illustrating the following embodiments, and sizes of these components do not represent sizes of actual products. For those skilled in the art, it will be understood that some known structures in the drawings and descriptions thereof may be omitted.

Embodiment 1

Figure 2:
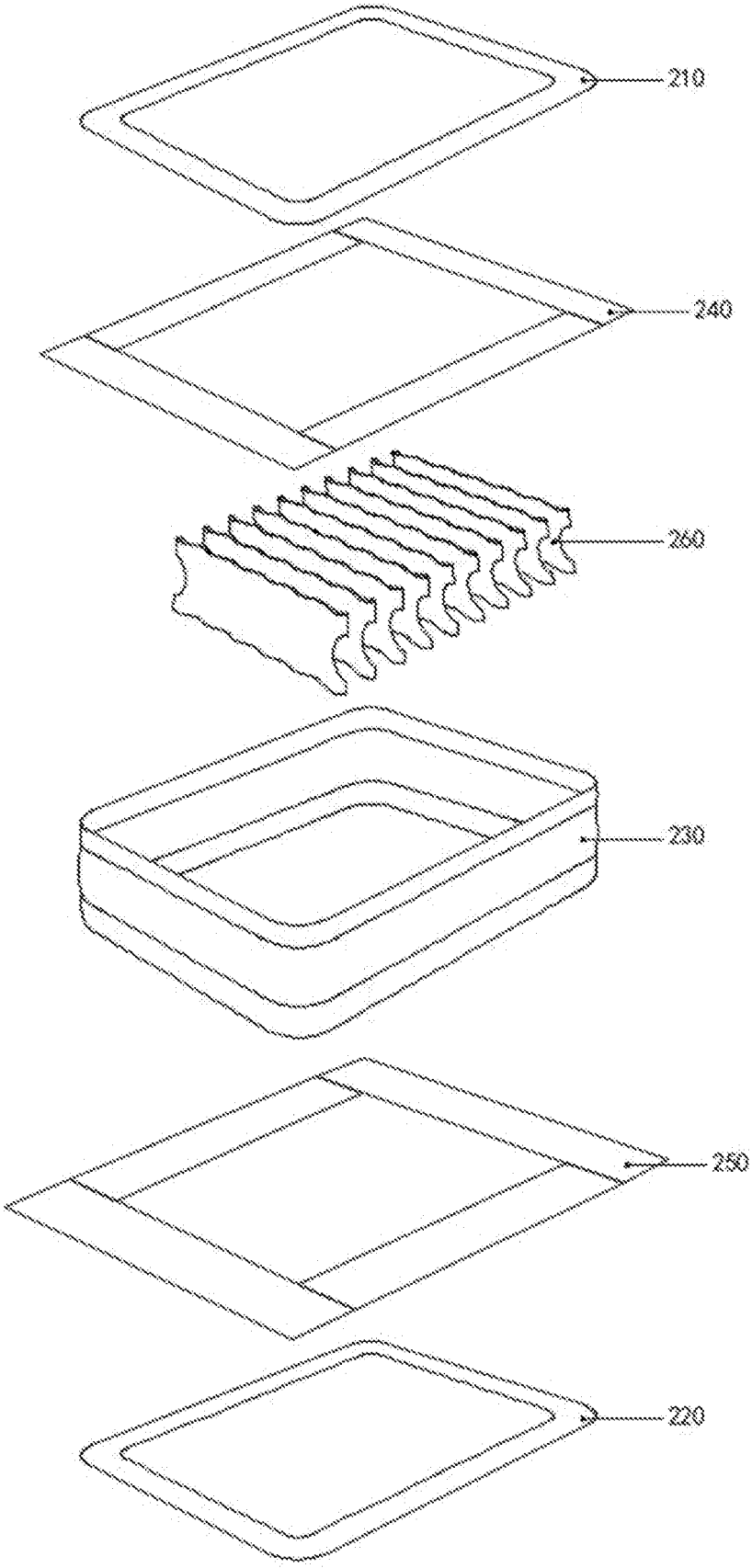
FIG. 2 is a schematic view of a split structure of the air bed in the present utility model.
Figure 3:
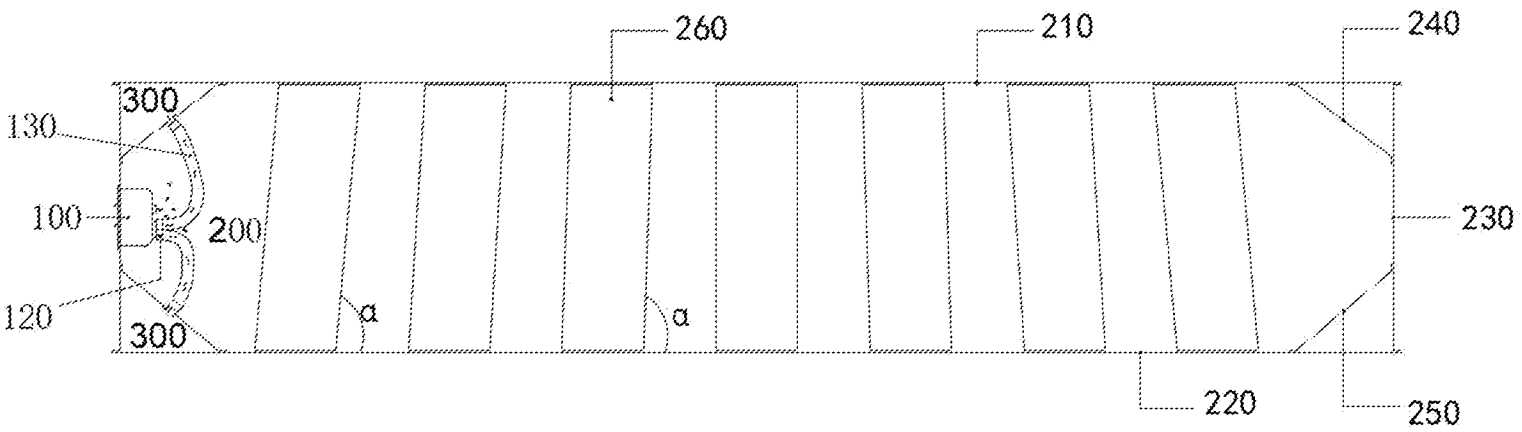
FIG. 3 is a schematic cross-sectional view of the air bed in the present utility model.

As shown in FIGS. 1, 2, and 3, a dual-chamber air bed includes an air pump 100, a bed body air chamber 200 and peripheral air chambers 300. The air bed is enclosed by a top surface 210, a bottom surface 220 and a side wall 230. An upper supplementary-material encircling piece 240 is provided between the top surface 210 and the side wall 230; a lower supplementary-material encircling piece 250 is provided between the bottom surface 220 and the side wall 230; the peripheral air chambers 300 are enclosed by the top surface 210, the side wall 230 and the upper supplementary-material encircling piece 240, or by the bottom surface 220, the side wall 230 and the lower supplementary-material encircling piece 250; and the bed body air chamber 200 is enclosed by the top surface 210, the bottom surface 220, the side wall 230, the upper supplementary-material encircling piece 240, and the lower supplementary-material encircling piece 250. The air pump 100 is provided with two inflation-deflation devices that are independently operated and connect the bed body air chamber 200 and the peripheral air chambers 300 respectively to perform independent inflation and deflation on the bed body air chamber 200 and the peripheral air chambers 300.

According to the technical solution, the arrangement of the peripheral air chambers 300 enables the periphery of the air bed to be more stable and firm, and can effectively prevent people from sliding off once people lie on the bed. The arrangement of two independently operated inflation-deflation devices is used to perform independent inflation and deflation on the peripheral air chambers 300 and the bed body air chamber 200, which can better control an amount of gas required by the peripheral air chambers 300 and the bed body air chamber 200 and meet the demands of people.

In the prior art, when the edge of the air bed is subjected to force, a bed body is easy to be partially collapsed or tilt without enough stability due to limited support strength of the side wall 230 and drawstrings 260. According to the technical solution, a mattress body is enclosed by the top surface 210, the side wall 230 and the bottom surface 220 to form a cuboid shape, and the peripheral air chambers 300 form bed edges of the air bed, which effectively improves the supporting strength of the bed edges. An upper bed edge is higher than the other positions of the top surface 210 so as to achieve the function of intercepting and limiting, so that a quilt can be effectively prevented from slipping off, and a user can be prevented from sliding off from the mattress during sleep. The arrangement of a lower bed edge increases friction between the mattress and the bottom surface 220, which achieves greater grip force of the mattress body that grasps the ground with more stability and realizes slip-resistance and increasing the comfort of use.

Figure 4:
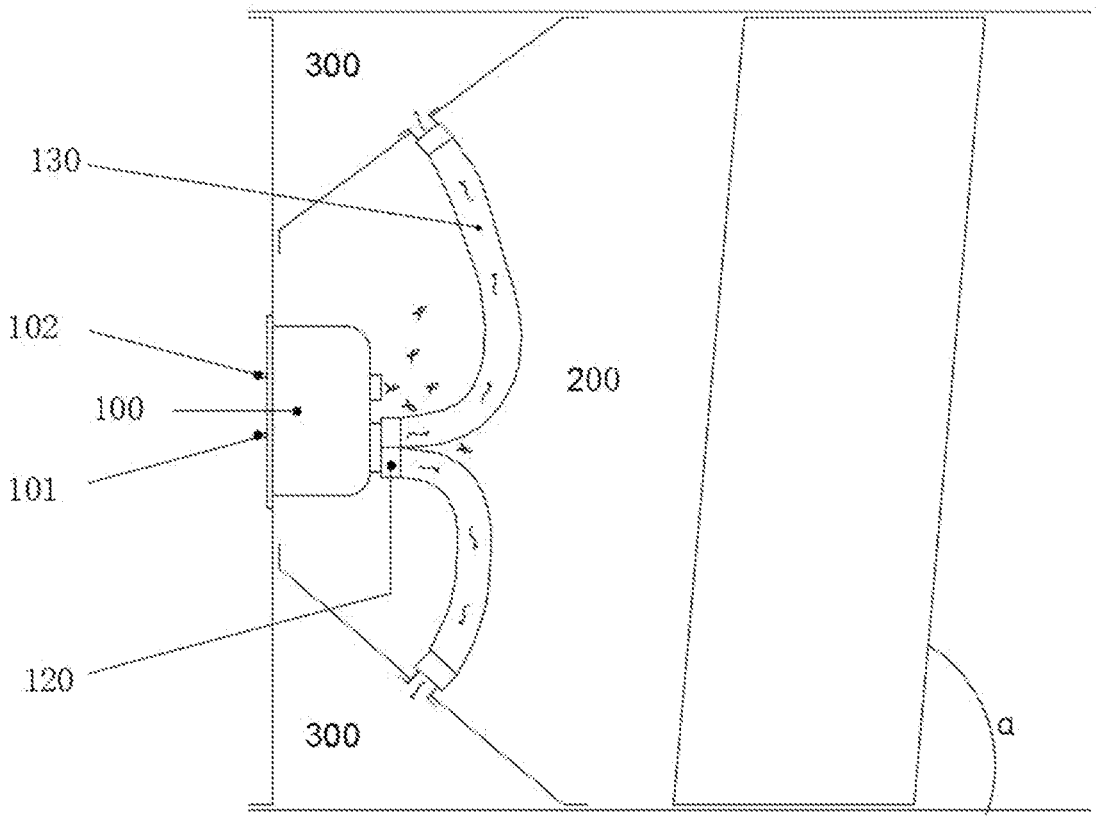
FIG. 4 is an enlarged view of an air pump section in FIG. 3.

As shown in FIG. 4, the inflation-deflation device connected with the peripheral air chambers 300 is a peripheral inflation-deflation device 101, the peripheral air chambers 300 are divided into an upper peripheral air chamber 300 and a lower peripheral air chamber 300. An air outlet of the peripheral inflation-deflation device 101 is communicated with the upper peripheral air chamber 300 and the lower peripheral air chamber 300 respectively.

The upper peripheral air chamber 300 is higher than the other positions of the top surface so as to achieve the function of intercepting and limiting, so that the quilt can be effectively prevented from slipping off, and the user can be prevented from sliding off from the mattress during sleep. The arrangement of the lower peripheral air chamber 300 increases the friction between the air bed and the bottom surface 220 so as to achieve greater grip force of the air bed that grasps the ground with more stability, thereby realizing slip-resistance and increasing the comfort of use.

As shown in FIG. 4, the air outlet of the peripheral inflation-deflation device 101 is provided with a double-pass device 120 having two outlets corresponding to two tubes 130 that are respectively connected with the upper peripheral air chamber 300 and the lower peripheral air chamber 300.

The technical solution ingeniously arranges two tubes 130 at the air outlet of the peripheral inflation-deflation device 101, so that inflation and deflation can be performed on the upper peripheral air chamber 300 and the lower peripheral air chamber 300 without an additional peripheral inflation-deflation device 101, and the cost is saved as a beneficial effect.

Each inflation amount of the upper peripheral air chamber 300 and the lower peripheral air chamber 300 can be controlled by a space size of the air outlet occupied by the tube 130, in which the tube 130 occupying a larger space of the air outlet obtains more air intake during the same time and has a larger hardness value of the corresponding air chamber.

An inflation-deflation device connected with the bed body air chamber 200 is a bed body inflation-deflation device 102, the air pump 100 is provided on the side wall 230 of the bed body air chamber 200, and an air outlet of the bed body inflation-deflation device 102 is provided in the bed body air chamber 200.

According to the technical solution, the peripheral inflation-deflation device 101 is communicated with the peripheral air chambers 300 through tubes 130, and the bed body inflation-deflation device 102 is in direct communication with the bed body air chamber 200, so that different air chambers can be respectively inflated and deflated by the same air pump 100, which has beneficial effects of being simple, convenient, and cost saving.

As shown in FIG. 3, the drawstrings 260 are provided in the bed body air chamber 200 and are at least partially provided in the bed body air chamber 200 in an inclined manner.

According to the technical solution, the top surface 210 of the mattress body corresponds to the surface that the user lies on, the bottom surface 220 of the mattress body corresponds to the surface in contact with the ground, and the drawstrings 260 act to restrain the mattress body from becoming a bed body in a flat shape. However, due to a consistent force direction, the vertically arranged drawstrings 260 still can cause projections of the top surface 210 and the periphery of the mattress body, that is, bread-like projections are formed, thus leading to poor aesthetics of the mattress. Vertical lines at the top of the drawstrings 260 and that at the bottom of the drawstrings 260 are not on the same straight line, and force bearing points of the top surface 210 and the bottom surface 220 are spaced apart from each other, so that the top surface 210 and the bottom surface 220 of the mattress body can have better constraints and can function to limit projections of the top surface 210 and the periphery of the mattress body. Meanwhile, the top surface 210 and the bottom surface 220 of the mattress body can receive more even forces and have better stability.

The drawstrings 260 are connected with the top surface 210 and the bottom surface 220 of the bed body air chamber 200 respectively, and form included angles with the bottom surface 220, in which the included angles gradually increase from both sides of the bed body air chamber 200 to the middle of the bed body air chamber 200 and tend to be right angles.

Further, an angle range of an included angle a formed by a drawstring 260 and the bottom surface 220 is 60 to 90 degrees.

Elasticity of the top surface 210 of the air bed is greater than that of the bottom surface 220.

Greater elasticity leads to a lower PVC hardness value, a larger expansion coefficient, a greater elasticity degree, and an easier tendency to be deformed. A parameter PHR means the parts of added rubber or resin per 100 parts (by mass) in PVC material, and a PVC hardness degree of the PVC is indirectly indicated by the parts of indirect adding of the rubber or the resin. According to the air bed in the present technical solution, the PVC hardness degree of the top surface 210 is 35 to 45 PHR, and the PVC hardness degree of the bottom surface 220 is 55 to 75 PHR. In this way, the air bed is kept flat with pleasing appearance, the surface of the air bed is prevented from forming the bread-like projections, which can better match and adapt to the hardness degree and the elasticity of the bed body.

The PVC hardness degree of a bonding layer of the top surface 210 is 40 PHR, and the PVC hardness degree of a bonding layer of the bottom surface 220 is 60 to 70 PHR.

According to the air bed in the present technical solution, the top surface 210 of the bed body is formed by bonding a flock layer and a PVC/TPU layer, both the bottom surface 220 and the side wall 230 of the mattress body are formed by bonding a cloth layer and a PVC/TPU layer, in which the flock layer of the top surface 210 is provided outside the PVC/TPU layer, the cloth layers on the bottom surface 220 and the side wall 230 are provided outside the PVC/TPU layer, and the PVC/TPU layers between the top surface 210 and the side wall 230 and between the bottom surface 220 and the side wall 230 are welded to each other to form a mattress structure.

By arranging the flock layer on the top surface 210 of the air bed, noise generated by friction between PVC material and human body can be reduced. In addition, the flock on the top surface 210 of the air bed enables the air bed to be more delicate with air ventilation, which provides a more comfortable feeling when human skin touches the bed and improves the comfort of use. Moreover, the cloth layer can reduce the noise generated when the air bed is touched, avoid rupture, and improve service life of the air bed. In addition, an air bed in the prior art tends to expand into an arc shape after inflation, which results in that the mattress body has bread-like projections, the air bed is not flat enough and does not have pleasing appearance, and the service life is affected. The arrangement of the cloth layer limits the expansion of the PVC/TPU layer, so that the stretch of the whole air bed is flatter with more pleasing appearance, a technical effect that the whole air bed is not easily deformed is achieved, the hardness degree of the air bed is improved, a higher comfort degree of the air bed is realized, and the service life is prolonged.

The cloth layer is made of cotton cloth or other materials.

The upper supplementary-material encircling piece 240 and the lower supplementary-material encircling piece 250 are made of PVC/TPU material, and are successively welded or bonded end to end to enclose a rectangular shape by PVC/TPU sheet materials.

In the present embodiment, the drawstrings 260 are in a sheet-like structure and are provided along inner circumference of the mattress body, and have a curved design at a joint of the top surface 210 and the bottom surface 220 of the mattress body.

Obviously, the above embodiment of the present utility model is merely an example for clear illustration of the utility model, and is not intended to limit the implementation of the utility model. Any modification, equivalent substitution or improvement and the like within the spirit and principle of the claims of the present utility model should be included in the scope of claims of the present utility model.

The invention claimed is:

1. A dual-chamber air bed, comprising:

an air pump;

a bed body air chamber; and peripheral air chambers, wherein the air bed is enclosed by a top surface, a bottom surface and a side wall, an upper supplementary-material encircling piece is provided between the top surface and the side wall, a lower supplementary-material encircling piece is provided between the bottom surface and the side wall, wherein the peripheral air chambers are enclosed by the top surface, the side wall and the upper supplementary-material encircling piece and by the bottom surface, the side wall and the lower supplementary-material encircling piece, wherein the bed body air chamber is enclosed by the top surface, the bottom surface, the side wall, the upper supplementary-material encircling piece, and the lower supplementary-material encircling piece, wherein the air pump is provided with two inflation-deflation devices that are independently operated and connect the bed body air chamber and the peripheral air chambers respectively to perform independent inflation and deflation on the bed body air chamber and the peripheral air chambers.

2. The dual-chamber air bed according to claim 1, wherein one of the two inflation-deflation devices connected with the peripheral air chambers is a peripheral inflation-deflation device, the peripheral air chambers are divided into an upper peripheral air chamber and a lower peripheral air chamber, and an air outlet of the peripheral inflation-deflation device is communicated with the upper peripheral air chamber and the lower peripheral air chamber respectively.

3. The dual-chamber air bed according to claim 2, wherein the air outlet of the peripheral inflation-deflation device is provided with a double-pass device having two outlets corresponding to two tubes that are respectively connected with the upper peripheral air chamber and the lower peripheral air chamber.

4. The dual-chamber air bed according to claim 1, wherein an inflation-deflation device connected with the bed body air chamber is a bed body inflation-deflation device, the air pump is provided on the side wall of the bed body air chamber, and an air outlet of the bed body inflation-deflation device is provided in the bed body air chamber.

5. The dual-chamber air bed according to claim 1, wherein drawstrings are provided in the bed body air chamber and are at least partially provided in the bed body air chamber in an inclined manner.

6. The dual-chamber air bed according to claim 5, wherein the drawstrings are connected with the top surface and the bottom surface of the bed body air chamber respectively, and form included angles with the bottom surface, in which the included angles gradually increase from both sides of the bed body air chamber to the middle of the bed body air chamber.

7. The dual-chamber air bed according to claim 5, wherein a range of included angles formed by the drawstrings and the bottom surface is 60 to 90 degrees.

8. The dual-chamber air bed according to claim 1, wherein an elasticity of the top surface of the air bed is greater than an elasticity of the bottom surface.

9. The dual-chamber air bed according to claim 5, wherein the drawstrings are in a sheet-like or columnar or ring structure, the sheet-like drawstrings are provided along inner circumference of the mattress body and have a curved or linear design at a joint of the top surface/bottom surface of the mattress body, and the drawstrings in the columnar or ring structure are uniformly provided in a space of the mattress body and are arranged in a matrix form.

10. The dual-chamber air bed according to claim 1, wherein the upper supplementary-material encircling piece and the lower supplementary-material encircling piece are made of PVC/TPU material, and are successively welded or bonded end to end to enclose a rectangular shape by PVC/TPU sheet materials.

* * * * *